US007360667B2

(12) United States Patent
Stravitz

(10) Patent No.: US 7,360,667 B2
(45) Date of Patent: Apr. 22, 2008

(54) TISSUE BOX WITH INTERMEDIATE TISSUE SUPPORT

(76) Inventor: David M. Stravitz, 16 Park Ave., New York, NY (US) 10016

( * ) Notice: Subject to any disclaimer, the term of this patent is extended or adjusted under 35 U.S.C. 154(b) by 236 days.

(21) Appl. No.: 11/262,471

(22) Filed: Oct. 28, 2005

(65) Prior Publication Data

US 2006/0180597 A1 Aug. 17, 2006

Related U.S. Application Data

(60) Provisional application No. 60/641,349, filed on Jan. 4, 2005, provisional application No. 60/622,726, filed on Oct. 28, 2004.

(51) Int. Cl.
*B65H 1/00* (2006.01)

(52) U.S. Cl. ..... 221/52; 221/63; 221/34

(58) Field of Classification Search ..... 221/34, 221/63, 52

See application file for complete search history.

(56) References Cited

U.S. PATENT DOCUMENTS

| | | | | |
|---|---|---|---|---|
| 2,307,146 | A * | 1/1943 | McCash et al. | 206/815 |
| 2,636,599 | A * | 4/1953 | Willis et al. | 221/48 |
| 3,603,452 | A * | 9/1971 | Singer | 221/56 |
| 5,197,631 | A * | 3/1993 | Mishima | 221/52 |
| 6,283,295 | B1 * | 9/2001 | Akutagawa et al. | 221/52 |

* cited by examiner

*Primary Examiner*—Gene O. Crawford
*Assistant Examiner*—Timothy R Waggoner
(74) *Attorney, Agent, or Firm*—Brian Roffe

(57) ABSTRACT

Tissue box including a top panel, at least one side panel and a bottom panel defining an r compartment receivable of tissues. A raised shelf is formed in the compartment above the bottom panel for supporting the tissues in a position closer to the top panel than if the tissues were supported on the bottom panel. The bottom panel includes perforation lines enabling the formation of flaps capable of extending inward into the compartment when the perforation lines are severed. When the flaps are formed, the raised shelf is provided by the upper edges of the flaps. A separate tissue support platform can be arranged inside the compartment and supported on and/or by the flaps.

17 Claims, 4 Drawing Sheets

TISSUE BOX WITH INTERMEDIATE TISSUE SUPPORT

CROSS REFERENCE TO RELATED APPLICATIONS

This application claims priority under 35 U.S.C. §119(e) of U.S. provisional patent application Ser. No. 60/622,726 filed Oct. 28, 2004 and U.S. provisional patent application Ser. No. 60/641,349 filed Jan. 4, 2005, both of which are incorporated by reference herein.

FIELD OF THE INVENTION

The present invention relates generally to a tissue box which provides improved dispensing of tissues therefrom and also to a method for improving the dispensing of tissues from a tissue box.

BACKGROUND OF THE INVENTION

Tissues are typically accordion-folded and placed into various sized boxes. To dispense the tissues, once the first tissue is pulled through a slot in the top panel of the box, as each tissue is individually pulled out of the box, the following tissue is only partially pulled through the slot to extend through the slot, i.e., automatically placed into a dispensing position. This feature is colloquially referred to as the automatic pop-up or auto pop-up feature.

One particular box has a height of about five inches and a length and depth substantially equal to the length and depth of each folded tissue. One problem which arises with such a box is that once the level of tissues is farther than about two inches from the top panel, the tissue has to travel a relatively large distance to the slot and in view of its inability to extend vertically upright without sufficient support, the tissue tends to fall back into the box (in spite of the fact that it extends through the slot). A jarring of the box might be all that is needed for this condition to occur, i.e., for the tissue to fall back into the box. As such, most boxes typically have clear film defining the slot to help retard this condition. The film is designed to provide a retaining force which maintains the tissue in a position extending through the slot and counters the tissue's tendency to fall back into the box.

Nevertheless, if the tissue falls back deep into the box, it becomes a challenge to dig into the box and find the starting tissue, then pull it up through the slot with reasonable force to enable the pop-up condition to re-start. Moreover, every time the person has to pass his or her hand through the slot, the slot stretches and expands and its ability to frictionally retain a tissue is reduced. As tissue depletion continues, this condition is exacerbated.

Gravity can cause this condition very often and repeatedly and thus it will repeatedly be required to dig deeper into the box to grasp the starting tissue. Once the level of remaining tissues is about 1 inch or less, the pop-up condition fails regularly.

OBJECTS AND SUMMARY OF THE INVENTION

It is an object of the present invention to provide a new and improved tissue box which provides improved dispensing of tissues therefrom.

It is another object of the present invention to provide a new and improved tissue box which significantly reduces and can even eliminate the problem of tissues falling back into the tissue box when the level of tissues is relatively distant from the slot.

It is another object of the present invention to provide a new and improved method for improving the dispensing of tissues from a tissue box.

In order to achieve these objects and others, a tissue box in accordance with the invention includes a top panel having a slot, at least one side panel and a bottom panel defining an interior compartment receivable of a stack of tissues. The bottom panel includes perforation lines having a form enabling the formation of a plurality of flaps capable of extending inward into the compartment when the perforation lines are severed and the flaps are bent around score lines. When the perforation lines are severed or torn and flaps are thereby formed, a raised shelf is provided by the flaps, i.e., by the free, inward edges of the flaps, in the compartment above the bottom panel and which is capable of supporting the tissues in a position closer to the top panel than if the tissues were supported on the bottom panel. In this manner, the distance between the uppermost tissue in the stack and the top panel is reduced or even possibly eliminated thereby reducing or eliminating the problem of tissues falling back into the compartment when extending through the slot in the top panel.

When a pair of opposed flaps are provided spaced apart from one another, a connecting flap may be provided connected to each of these opposed flaps in order to maintain the opposed flaps in an upright position forming the shelf, i.e., an H-shaped structure is formed by the flaps. The connecting flap extends between the opposed flaps and is connected to them by, for example, tabs on lateral edges of the connecting flap which extend through slots in the opposed flaps.

In another embodiment of a tissue box in accordance with the invention, the perforation lines in the bottom panel are formed to define a tab on each flap along a portion of an upper edge thereof. The tissue box also includes a tissue support platform having a pair of notches arranged relative to the tabs such that the tabs are insertable through the notches when the flaps are formed. The raised shelf is constituted by the tissue support platform, which is preferably substantially coextensive with an interior cross-section of the tissue box.

Another way to consider the invention is as a tissue box which includes a top panel, at least one side panel and a bottom panel defining an interior compartment receivable of a stack of tissues, the top panel including a slot, and structure for forming a raised shelf in the compartment above the bottom panel and which is capable of supporting the tissues in a position closer to the top panel than if the tissues were supported on the bottom panel. The structure for forming the raised shelf may be a plurality of flaps formed on the bottom panel and arranged to extend inward into the compartment when perforation lines defining the flaps are severed. The upper edges of the flaps, when extending inward into the compartment, can form the raised shelf or a tissue support platform can be provided to define the raised shelf. The tissue support platform can be maintained in an elevated position above the bottom panel by providing it with notches and forming a tab on each flap along a portion of an upper edge of the flap such that the tabs are insertable through the notches when the flaps are formed, i.e., pressed inward to pivot away from the bottom panel. The tissue support platform can be supported in an elevated position by means other than the cooperating notches and tabs.

A related method for improving dispensing of tissues from a tissue box having the form described above involves forming perforation lines in the bottom panel having a form enabling the formation of a plurality of flaps, forming the flaps by pressing along the perforation lines once the level of tissues is relatively distant from the top panel and pressing the flaps inward into the compartment to provide a raised shelf for the tissues at a height above the bottom panel. The raised shelf reduces the distance between the uppermost tissue in a stack of tissues in the compartment and the top panel. In a preferred embodiment, the perforation lines are formed such that the flaps have substantially the same height when pressed inward into the compartment perpendicular to the bottom panel, i.e., to provide the shelf with a horizontal orientation parallel to the bottom panel.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
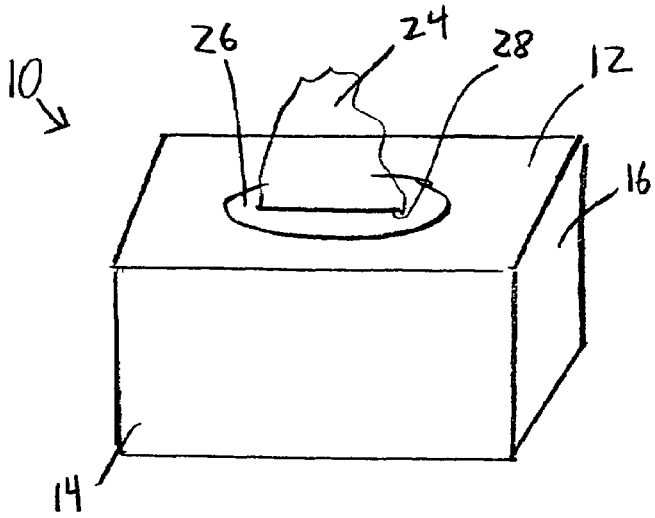
FIG. 1 is a front, top perspective view of a tissue box in accordance with the invention.

Referring to the accompanying drawings wherein like reference numbers refer to the same or similar elements, a first embodiment of a tissue box in accordance with the invention is designated generally as 10 and includes a top panel 12, two pairs of opposed side panels 14, 16 and a bottom panel 18 defining an interior compartment 20 receivable of a stack 22 of accordion-folded tissues 24 or other similar items. A film sheet 26 is adhered to the top panel 12 and defines a slot 28 through which the tissues 24 are dispensed from the compartment 20.

Figure 2:
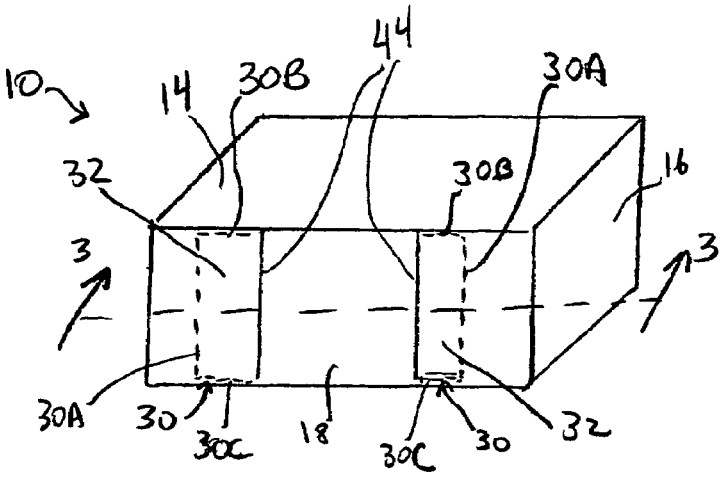
FIG. 2 is a bottom perspective view of a tissue box in accordance with the invention.
Figure 3:
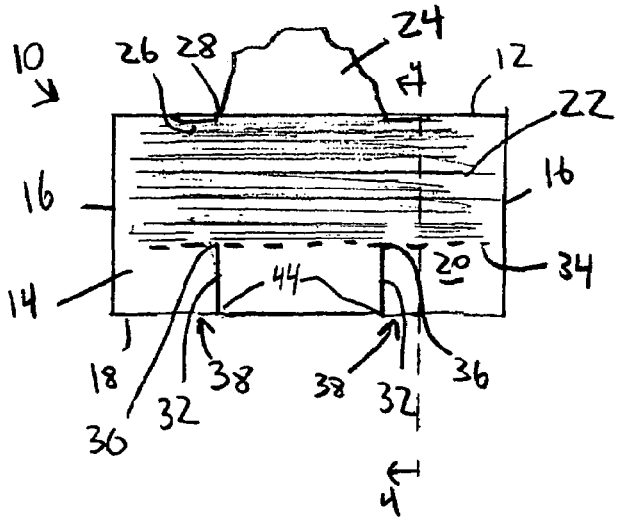
FIG. 3 is a cross-sectional view taken along the line 3-3 of FIG. 2.

To avoid the problem of the tissues 24 having a tendency to fall back into the compartment 20 once the level of tissues 24 is relatively distant from the top panel 12, e.g., about two inches therefrom, perforation lines 30 are formed in the bottom panel 18 (see FIG. 2). The form of the perforation lines 30 is designed to enable the formation of flaps 32 when the perforation lines 30 are severed or torn which can extend inward into the compartment 20 (see FIG. 3). The flaps 32 serve to create a raised shelf 34 (represented by the dotted line in FIG. 3) for the stack 22 of tissues 24 above the bottom panel 18 on which the stack 22 of tissues 24 initially rests. The raised shelf 34 is constituted by the two support edges 36 of the flaps 32. The height of the flaps 32 is preferably the same when the flaps 32 are perpendicular to the bottom panel 18 (as shown in FIG. 3).

Perforation lines 30 may be formed by forming a series of cuts or openings in the bottom panel 18 or may be weakened score lines. In one embodiment, the perforation lines 30 are formed to enable the flaps 32 to be easily pushed inward. To this end, the perforation lines 30 may be formed by perforations which are separated only by small pieces of the bottom panel 18 which are easily severed upon the application of pressure to the flaps 32.

Although two flaps 32 are shown, any number of flaps 32 can be provided so long as a secure shelf 34 is created in the compartment 20. For example, three flaps 32 can be formed spaced equidistant along the bottom panel 18. Also, flaps 32 are capable of being substantially parallel to one another when in an upright position and parallel to the side panels 16. However, flaps 32 can be formed at an angle to the side panels and/or at an angle to one another.

In use, the tissue box 10 would be used in the conventional manner until such time as the stack 22 of tissues 24 is relatively distant from the top panel 12, e.g., once the top of the stack 22 of tissues 24 is about two inches from the top panel 12 or whenever the problem of tissues 24 falling back into the compartment 20 upon jarring or movement of the box 10 arises. At this time, the box 10 is turned over and the flaps 32 are pressed inward causing the perforation lines 30 to be severed. Shelf 34 is thereby formed.

Tissue box 10 is then turned back over so that the tissues 24 remaining in the stack 22 engage and rest on the shelf 34 formed from the two support edges 36. The flaps 32 might be held in a position substantially perpendicular to the bottom panel 18 until the tissues 24 rest on the support edges 36. The tissues 24 are thus closer to the top panel 12 and slot 28 and the tissue box 10 then functions as a freshly opened tissue box would without any problem with tissues falling back into the compartment 20.

The main difference between the modified tissue box in accordance with the invention and a conventional tissue box is the presence of openings 38 in the lower panel 18 from which the flaps 32 are formed. However, these openings 38 are not visible when the tissue box 10 rests on the bottom panel 18.

Figure 4:
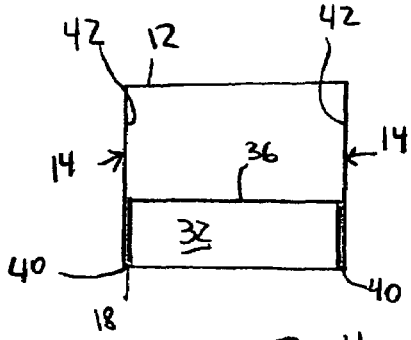
FIG. 4 is a cross-sectional view taken along the line 4-4 of FIG. 3.

Since the material from which the tissues 24 is made is resilient and has a certain coefficient of friction, the engagement of the lowermost tissue 24 with the support edges 36 and gravitational force assists in keeping the raised flaps 32 from collapsing. Also, the closer to the side edges 40 of the bottom panel 18 these flaps 32 are formed, the more they will engage the inner surface 42 of the side panels 14 of the tissue box, which is somewhat coarse to begin with, and thus the better the tissues 24 will stay in place (see FIG. 4). The combined effect of the tissues 24 resting on the support edges 36 of the flaps 32 and the frictional engagement between the side of the flaps 32 and the inner surfaces 42 of the side panels 14 will aid in retaining the flaps 32 in a raised state.

To form rectangular flaps 32, the perforation lines 30 comprise two sets of perforation lines, each set including a first perforation line 30A substantially parallel to side panels 16 and extending substantially the entire distance between side panels 14, and second and third perforation lines 30B, 30C parallel to side panels 14 and extending close to or alongside each side panel 14, i.e., as close as possible to the side edges 40 of the bottom panel 18 (see FIG. 2). The second and third perforation lines 30B, 30C are perpendicular to the first perforation line 30A. A hinge is therefore formed as the flaps 32 are bent inward. In this manner, a rectangular flap 32 is formed with the side edges of the rectangular flaps 32 coming into contact with the inner surfaces 42 of the side panels 14.

To facilitate the formation of the flaps 32, score lines 44 are formed parallel to the perforation lines 30A. Instead of score lines 44, other types and forms of weakened lines may be provided. The presence of score lines 44 facilitates the bending of the flaps 32.

It is preferred that the flaps 32 are pressed inward into the compartment 20 to a position in which they are substantially perpendicular to the bottom panel 18. Nonetheless, the invention will still be operable if the angle between the raised flaps 32 and the bottom panel 18 is off a few degrees in either direction. The tissues resting on the flaps 32 will keep them in place since the lowermost tissue has little wiggle room and is restrained by the dimensions of the inner surfaces of the side panels 14, 16.

Figure 5:
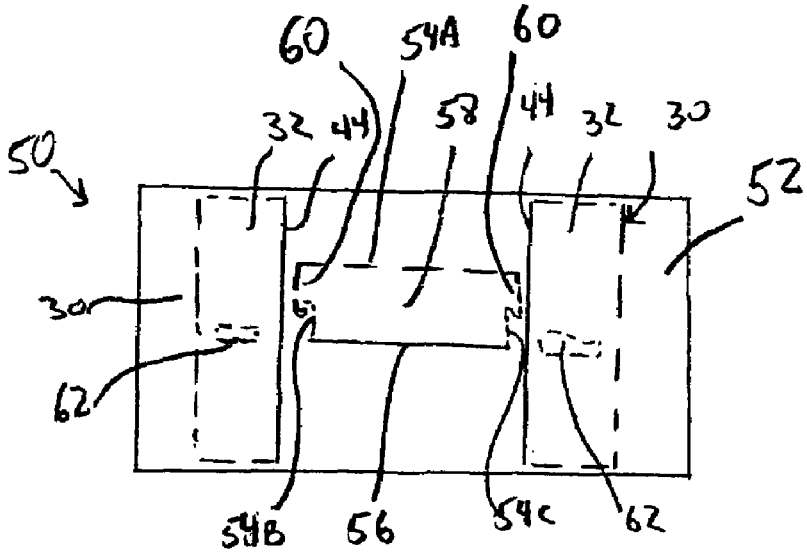
FIG. 5 is a bottom view of a second embodiment of a tissue box in accordance with the invention.
Figure 6:
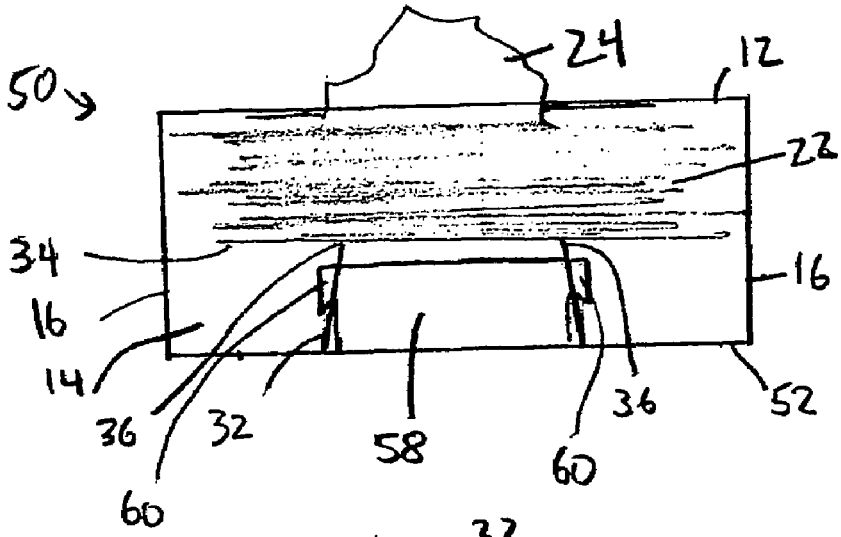
FIG. 6 is a cross-sectional view of the tissue box shown in FIG. 5 after a tissue support platform is formed from the bottom panel.
Figure 7:
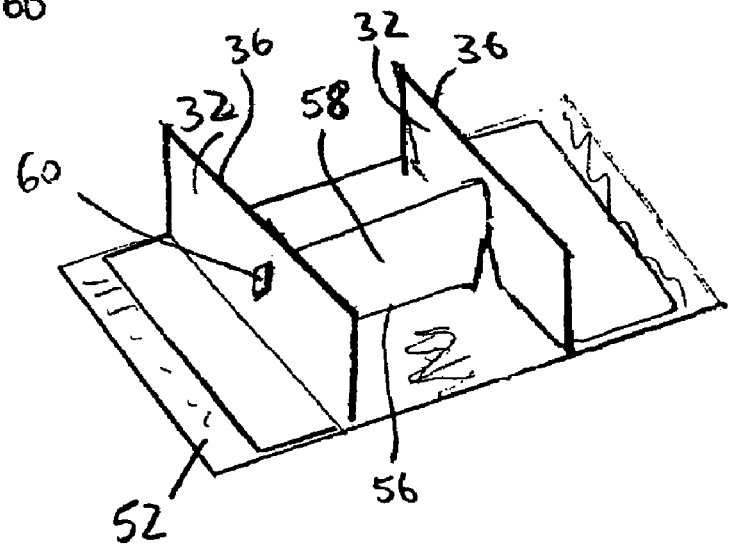
FIG. 7 is a perspective view of the tissue support platform formed from the bottom panel of the tissue box shown in FIG. 5

Referring now to FIGS. 5-7, another embodiment of a tissue box in accordance with the invention is generally designated 50 and includes the same structure as tissue box 10 except for a different bottom panel 52. The bottom panel 52 of tissue box 50 includes perforation lines 30 and score lines 44 as in bottom panel 18 but also includes perforation lines 54A, 54B, 54C and a score line 56 which enable the formation of a central support flap 58 between the flaps 32.

Central flap 58 is folded into compartment 20 about the score line 56 once the perforation lines 54A, 54B, 54C are severed or torn and is connected to the flaps 32 to hold the flaps 32 together and thereby form a more secure platform for the stack 22 of tissues 24. To connect flap 58 to flaps 32, lateral perforation lines 54B and 54C are arranged to form lateral tabs 60 which are designed to pass through slots 62 formed in each flap 32 (see FIGS. 6 and 7). Slots 62 may be formed by perforation lines which must be pressed inward to open the slots 62 or even by the removal of the material forming the bottom panel 18 therefrom.

Score line 56 does not extend fully between the score lines 44 and the lateral perforation lines 54B and 54C are spaced apart from the score lines 44. In this manner, the flaps 32 when in the upright state shown in FIG. 6 will be bent inward slightly more than 90° from the bottom panel 18 in order to engage with the flap 58.

Although as shown in FIG. 6, the height of the central flap 58 is less than the height of the flaps 32, so that the lowermost tissue 24 in the stack 22 rests only the support edges 36 of the flaps 32 and not on the upper edge of the central flap 58, it is possible to have the height of the central flap 58 the same as the height of the flaps 32.

In use, the tissue box 10 would be used in the conventional manner until such time as the stack 22 of tissues 24 is relatively distant from the top panel 12, e.g., once the top of the stack 22 of tissues 24 is about two inches from the top panel 12 or whenever the problem of tissues 24 falling back into the compartment 20 upon jarring or movement of the box 10 arises. At this time, the box 10 is turned over and the flaps 32, 58 are formed by pressing along the perforation lines 30, 54A, 54B, 54C. The tabs 60 are passed through the slots 62 to engage with the flaps 32 and serve to maintain the flaps 32 in an upright position.

Tissue box 10 is then turned back over so that the tissues 24 remaining in the stack 22 engage and rest on the shelf 34 formed from the support edges 36. The tissues 24 are thus closer to the top panel 12 and slot 28 and the tissue box 10 then functions as a freshly opened tissue box would without any problem with tissues falling back into the compartment 20.

Figure 8:
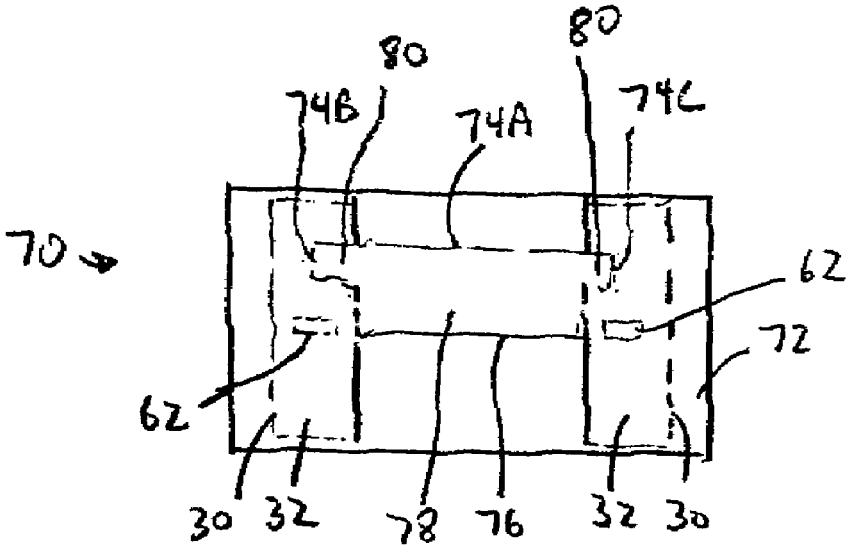
FIG. 8 is a bottom view of a second embodiment of a tissue box in accordance with the invention.
Figure 9:
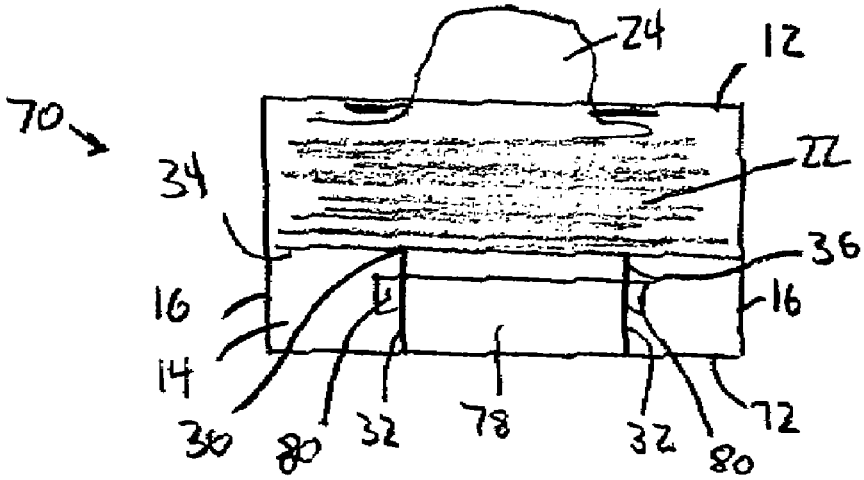
FIG. 9 is a cross-sectional view of the tissue box shown in FIG. 8 after a tissue support platform is formed from the bottom panel.
Figure 10:
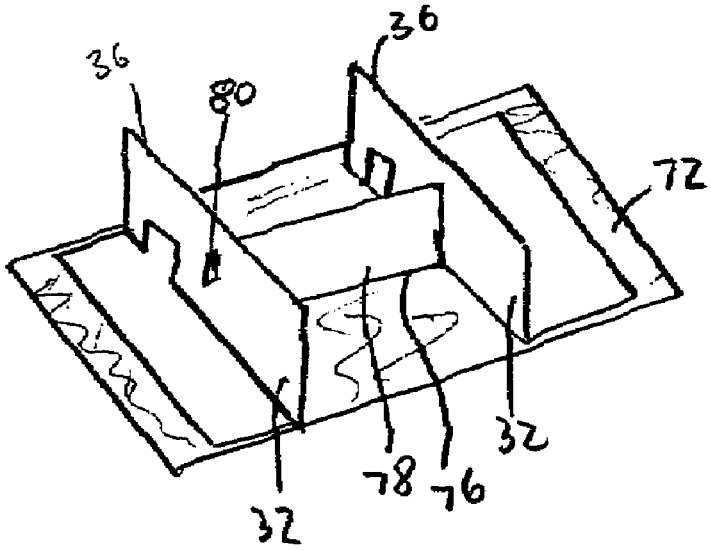
FIG. 10 is a perspective view of the tissue support platform formed from the bottom panel of the tissue box shown in FIG. 8.

Referring now to FIGS. 8-10, another embodiment of a tissue box in accordance with the invention is generally designated 70 and includes the same structure as tissue box 50 except for a different bottom panel 72. The bottom panel 72 of tissue box 70 includes perforation lines 30, score lines 44 and slots 62 as in bottom panel 52 but also includes perforation lines 74A, 74B and 74C and a score line 76 which enable the formation of a central support flap 78 between the flaps 32.

Central flap 78 is folded into compartment 20 about the score line 76 once the perforation lines 74A, 74B and 74C are severed or torn and is connected to the flaps 32 to hold the flaps 32 together and thereby form a more secure platform for the stack 22 of tissues 24. To connect flap 78 to flaps 32, lateral perforation lines 74B and 74C are arranged to form lateral tabs 80 which are designed to pass through the slots 62 formed in each flap 32 (see FIG. 9). Tabs 80 are actually formed from a portion of the flaps 32 (see FIG. 8).

Score line 76 extends fully between the score lines 44 and the lateral perforation lines 74B and 74C are partially in line with the score lines 44. In this manner, the flaps 32 when in the upright state shown in FIG. 9 will be substantially perpendicular to the bottom panel 18.

Although as shown in FIG. 9, the height of the central flap 78 is less than the height of the flaps 32, so that the lowermost tissue 24 in the stack 22 rests only the support edges 36 of the flaps 32 and not on the upper edge of the central flap 78, it is possible to have the height of the central flap 78 the same as the height of the flaps 32.

In use, the tissue box 70 would be used in the conventional manner until such time as the stack 22 of tissues 24 is relatively distant from the top panel 12, e.g., once the top of the stack 22 of tissues 24 is about two inches from the top panel 12 or whenever the problem of tissues 24 falling back into the compartment 20 upon jarring or movement of the box 10 arises. At this time, the box 70 is turned over and the flaps 32, 78 are formed by pressing along the perforation lines 30, 74A, 74B, 74C. The tabs 80 are passed through the slots 62 to engage with the flaps 32 and serve to maintain the flaps 32 in an upright position.

Tissue box 70 is then turned back over so that the tissues 24 remaining in the stack 22 engage and rest on the shelf 34 formed from the support edges 36. The tissues 24 are thus closer to the top panel 12 and slot 28 and the tissue box 10 then functions as a freshly opened tissue box would without any problem with tissues falling back into the compartment 20.

Figure 11:
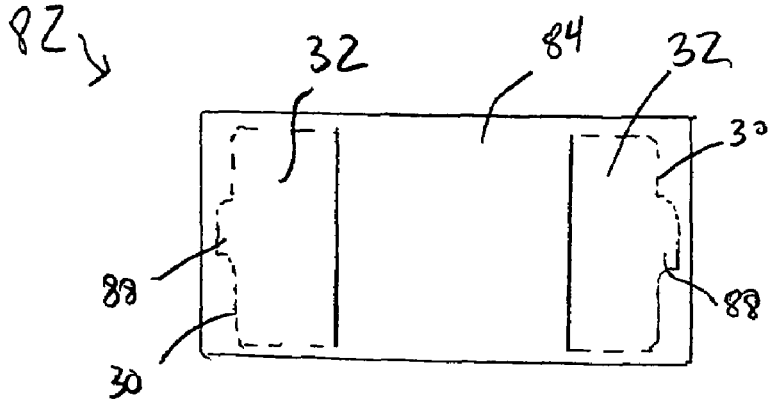
FIG. 11 is a bottom view of a second embodiment of a tissue box in accordance with the invention.
Figure 12:
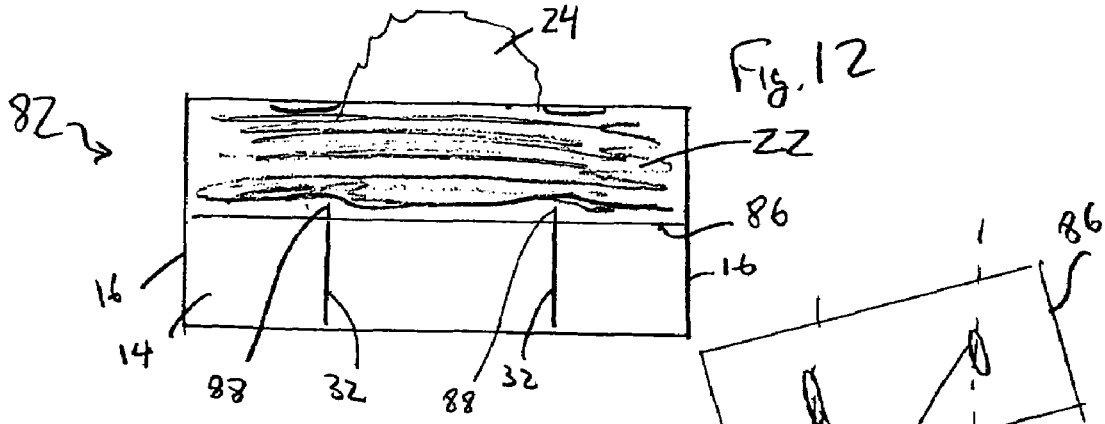
FIG. 12 is a cross-sectional view of the tissue box shown in FIG. 11 after tissue platform supports are formed from the bottom panel.
Figure 13:
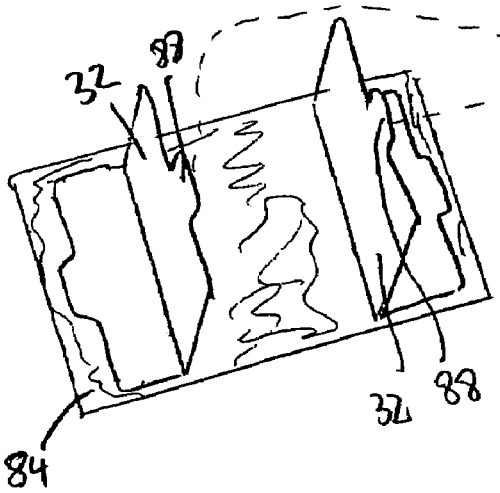
FIG. 13 is an exploded perspective view of the tissue platform formed in the tissue box shown in FIG. 11.

Referring now to FIGS. 11-13, another embodiment of a tissue box in accordance with the invention is generally designated 82 and includes essentially the same structure as tissue box 10 except for a different bottom panel 84 and a tissue support platform 86. The bottom panel 84 of tissue box 82 includes perforation lines 30, score lines 44 as in bottom panel 18 but the perforation lines 30 are formed to define tabs 88 when the flaps 32 are pressed inward into the tissue box 82. Tabs 88 are formed on the flaps 32 along a portion, preferably a central portion, of the upper edge of the flaps 32.

Tissue support platform 86 has a pair of notches 90 arranged relative to the tabs 88 such that the tabs 88 can be easily inserted into the notches 90 when the flaps 32 are formed (see FIGS. 12 and 13). Tissue support platform 86 is a preferably planar substrate made for example of chipboard or cardboard. It rests on the bottom panel 84 when the tissue box 82 is manufactured and used. Tissue support platform 86 can be dimensioned to fit tightly and snugly in the interior of the tissue box 82. When the flaps 32 are formed and pressed inward into the tissue box 82, the tissue support platform 86 rises until the tabs 88 enter into the notches 90 thereby forming a stable intermediate shelf in the tissue box 82 on which the tissues 24 are supported. If the tissue support platform 86 is formed with a tight fit against the side panels 14, 16 of the tissue box 82, the friction between the edges of the tissue support platform 86 and the inner sides of the side panels 14, 16 aids in the stability of the tissue support platform 86.

In use, the tissue box 82 would be used in the conventional manner until such time as the stack 22 of tissues 24 is relatively distant from the top panel 12, e.g., once the top of the stack 22 of tissues 24 is about two inches from the top panel 12 or whenever the problem of tissues 24 falling back into the compartment 20 upon jarring or movement of the box 82 arises. At this time, the flaps 32 are formed by pressing along the perforation lines 30. The flaps 32 are pressed inward into the tissue box 82 (while the tabs 88 are in contact with the underside of the tissue support platform 86) until the tabs 88 are passed into and lock with the notches 90 on the tissue support platform 86. When this happens, a stable shelf for the stack 22 of tissues 24 is formed at an intermediate height position in the tissue box 82. The tissues 24 are thus closer to the top panel 12 and slot 28 and the tissue box 82 then functions as a freshly opened tissue box would without any problem with tissues falling back into the compartment 20.

In this embodiment, it is not necessary to turn the tissue box 82 over in order to create the intermediate support shelf. Rather, the tissue box 82 can be held in its usual dispensing position and the flaps 32 pressed inward and upward.

Another advantage of this embodiment is that the presence of the tissue support platform 86 extending across substantially the entire cross-section of the tissue box 82 prevents dust from entering into the interior of the tissue box 82 below the tissues 24. By contrast, in the absence of a tissue support platform, dust could enter into the interior of the tissue box through the openings formed when the flaps 32 are pressed inward.

Tissue support platform 86 can be used in any of the other embodiments shown herein, e.g., in the embodiments shown in FIGS. 1-10, with or without the notches 90 to provide a support for the stack 22 of tissues 24. If the tissue support platform 86 is not provided with notches 90, then the flaps are not provided with corresponding tabs. Thus, in some embodiments, the flaps might include tabs to engage with notches on a tissue support platform and a central flap also provided to connect the flaps together.

During the inward pressing of the flaps 32, the stack 22 of tissues 24 rises essentially uniformly upward since the stack 22 continues to rest on the tissue support platform 86, which forms the bottom of the tissue box 82. Since the tissue support platform 86 constitutes the bottom of the tissue box 82 on which the stack 22 of tissues 24 rests, it becomes possible to decrease the size of, and possibly eliminate, the bottom panel 18, so long as the flaps 32 are maintained in some form.

In the embodiment shown in FIGS. 11-13, the flaps 32 are shown formed such that they would rotate toward one another when pressed inward into the tissue box. It is also possible to form the flaps to rotate away from one another when pressed inward into the tissue box, i.e., with the score line closer to the side panels 16, or to rotate in the same direction. The same alternative possibilities apply to the other embodiments herein to the extent possible.

Although the invention is shown in conjunction with a tissue box 10 having a rectangular cross-section, i.e., side panels 14 are parallel to one another and side panels 16 are parallel to one another and perpendicular to side panels 14, the invention encompasses other configurations and shapes of tissue boxes. Thus, at a minimum, a tissue box in accordance with the invention has a top panel defining a slot, a bottom panel on which a stack of tissue initially rests and at least one side panel extending between the bottom and top panels and defining a tissue-receiving compartment therebetween.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A tissue box, comprising:

a top panel, at least one side panel and a bottom panel defining an interior compartment receivable of a stack of tissues, said top panel including a slot, said bottom panel including perforation lines having a form enabling the formation of a plurality of flaps capable of extending inward into said compartment when said perforation lines are severed, said plurality of flaps including a pair of opposed flaps and a connecting flap arranged to be connected at opposite ends to said opposed flaps to thereby maintain said opposed flaps in an upright position in said compartment, whereby when said perforation lines are severed and said plurality of flaps are formed, a raised shelf is provided in said compartment above said bottom panel and which is capable of supporting the tissues in a position closer to said top panel than if the tissues were supported on said bottom panel.

2. The tissue box of claim 1, wherein said shelf is constituted by support edges of at least said opposed flaps.

3. The tissue box of claim 1, wherein said perforation lines are formed such that at least said opposed flaps have substantially the same height and said opposed flaps are substantially parallel to one another.

4. The tissue box of claim 1, wherein said at least one side panel comprises a first pair of opposed, substantially parallel side panels and a second pair of opposed, substantially parallel side panels arranged perpendicular to the first pair of side panels, said perforation lines comprising two sets of perforation lines, each set including a first perforation line substantially parallel to said first pair of side panels and extending substantially the entire distance between said second pair of side panels, and second and third perforation lines parallel to said second pair of side panels and extending close to or alongside each of said second pair of panels, said second and third perforation lines being perpendicular to said first perforation lines.

5. The tissue box of claim 1, wherein said bottom panel includes score lines about which said flaps are foldable.

6. The tissue box of claim 1, wherein said connecting flap is defined by lateral perforation lines alongside but not in line with score lines of said opposed flaps about which said opposed flaps bend.

7. The tissue box of claim 6, wherein each of said lateral perforation lines includes a tab, said opposed flaps each including a slot into which a respective one of said tabs passes to thereby connect said connecting flap to said opposed flaps.

8. The tissue box of claim 1, wherein said connecting flap is defined by lateral perforation lines in line with score lines of said opposed flaps about which said opposed flaps bend such that said opposed flaps are held by said connecting flap in a position substantially perpendicular to said bottom panel.

9. The tissue box of claim 8, wherein each of said lateral perforation lines includes a tab, said opposed flaps each including a slot into which a respective one of said tabs passes to thereby connect said connecting flap to said opposed flaps.

10. The tissue box of claim 1, wherein said perforation lines in said bottom panel are formed to define a tab on each of said opposed flaps along a portion of an upper edge of said flap, further comprising a tissue support platform having a pair of notches arranged relative to said tabs such that said tabs are insertable through said notches when said opposed flaps are formed, said raised shelf being constituted by said tissue support platform.

11. The tissue box of claim 10, wherein said tissue support platform is substantially coextensive with an interior cross-section of the tissue box.

12. The tissue box of claim 1, further comprising a substantially planar tissue support platform arranged above said bottom panel such that tissues rest on said tissue support platform and said tissue support platform is elevated when said flaps are formed to thereby define the raised shelf.

13. A tissue box, comprising:

a top panel, at least one side panel and a bottom panel defining an interior compartment receivable of a stack of tissues, said top panel including a slot, and means for forming a raised shelf in said compartment above said bottom panel and which is capable of supporting the tissues in a position closer to said top panel than if the tissues were supported on said bottom panel, said means comprising plurality of flaps formed on said bottom panel and arranged to extend inward into said compartment when perforation lines defining said flaps are severed, said plurality of flaps including a pair of opposed flaps and a connecting flap arranged to be connected at opposite ends to said opposed flaps to thereby maintain said opposed flaps in an upright position in said compartment.

14. The tissue box of claim 13, wherein said perforation lines are formed to define a tab on each of said opposed flaps along a portion of an upper edge of said flap, said means further comprising a tissue support platform having a pair of notches arranged relative to said tabs such that said tabs are insertable through said notches when said opposed flaps are formed, said raised shelf being constituted by said tissue support platform.

15. The tissue box of claim 14, wherein said tissue support platform is substantially planar and is arranged above said bottom panel, said plurality of flaps being arranged to support said tissue support platform in an elevated position above said bottom panel.

16. A method for improving dispensing of tissues from a tissue box having a top panel, at least one side panel and a bottom panel defining an interior compartment receivable of a stack of tissues, the top panel including a slot, comprising:

forming perforation lines in the bottom panel having a form enabling the formation of a plurality of flaps including a pair of opposed flaps and a connecting flap arranged between the opposed flaps;

forming the flaps by pressing along the perforation lines once the level of tissues is relatively distant from the top panel;

pressing the flaps inward into the compartment to provide a raised shelf for the tissues at a height above the bottom panel, the raised shelf reducing the distance between the uppermost tissue in a stack of tissues in the compartment and the top panel; and connecting opposite ends of the connecting flap to the opposed flaps to maintain the opposed flaps in an upright position in the compartment.

17. The method of claim 16, further comprising forming the perforation lines such that the opposed flaps have substantially the same height when pressed inward into the compartment.

* * * * *